United States Patent [19]

Wolff

[11] 4,141,542

[45] Feb. 27, 1979

[54] CLAMPING APPARATUS FOR WORKPIECES

[76] Inventor: Robert Wolff, Im Kiesacker, 5446 Engeln, Fed. Rep. of Germany

[21] Appl. No.: 931,291

[22] Filed: Aug. 4, 1978

[30] Foreign Application Priority Data

Oct. 15, 1977 [DE] Fed. Rep. of Germany ..... 2746401

[51] Int. Cl.[2] ..... B25B 1/22

[52] U.S. Cl. ..... 269/88; 269/98; 269/155

[58] Field of Search ..... 269/88, 97, 98, 152, 269/155, 249

[56] References Cited

U.S. PATENT DOCUMENTS

| | | | |
|---|---|---|---|
| 555,614 | 3/1896 | Mowrer | 269/155 X |
| 812,699 | 2/1906 | Stevens | 269/98 |
| 961,983 | 6/1910 | Morse | 269/98 |
| 2,778,393 | 1/1957 | Golasowski | 269/97 X |

*Primary Examiner*—Robert C. Watson

[57] ABSTRACT

A clamping apparatus adapted to be clamped to a table top in a do-it-yourself home workshop comprising a C-shaped clamping element provided with a guiding ledge and an upwardly projecting stop, both of which serve to contact a workpiece at a right angle intersection of the ledge and stop. The apparatus is further provided with a U-shaped clamping element which, in conjunction with the C-shaped clamping element, serves to hold said workpiece in a desired fixed position. The U clamp comprises a U-shaped body portion and a threaded screw element with a centering head on one end thereof and a knob on the other end which engages a threaded aperture on one leg of the U clamp. A centrally located aperture in the upwardly projecting stop of the C clamp cooperates with the centering head to axially guide such centering head of the screw element of the U clamp to thereby encircle the workpiece.

4 Claims, 8 Drawing Figures

Fig. 3
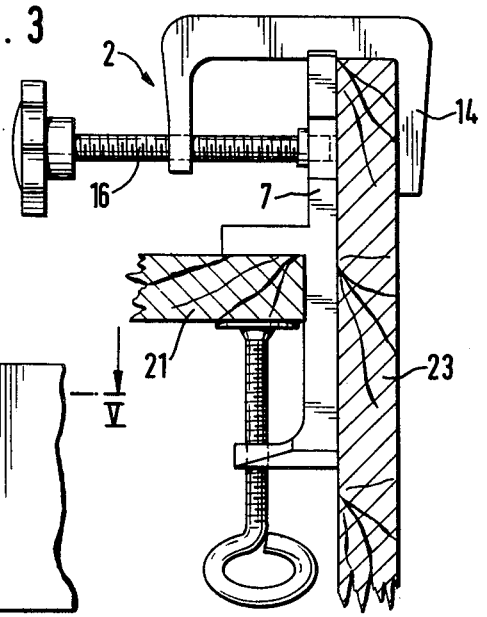
Fig. 4
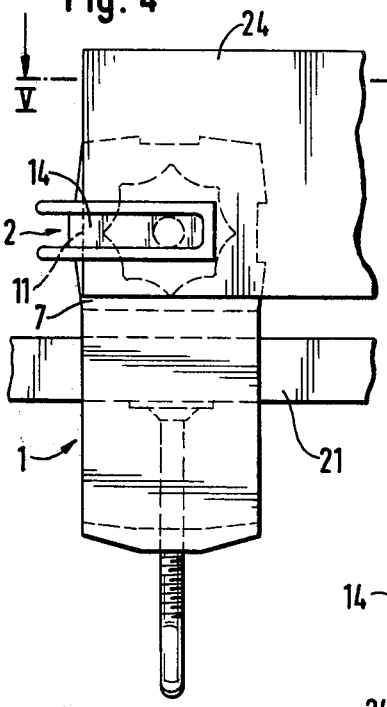
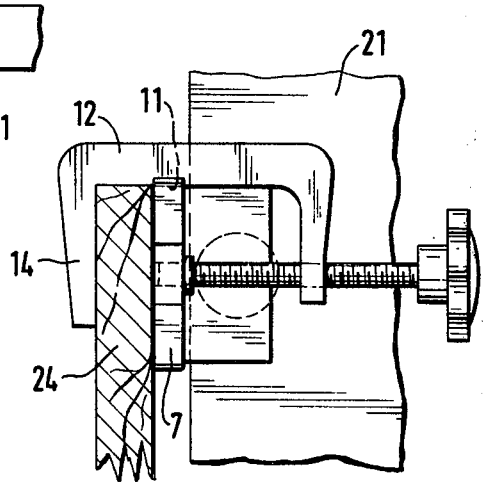
Fig. 5

CLAMPING APPARATUS FOR WORKPIECES

CROSS REFERENCE TO RELATED APPLICATION

Reference is made to applicant's German Application, No. P 27 46 401.3 which was filed in Germany on Oct. 15, 1977 and under which priority is claimed under 35 USC 119.

BACKGROUND OF THE INVENTION

1. Field of the Invention

The invention relates to a clamping apparatus for the clamping of a workpiece, such as a board, panel or similar object, to a table top or workbench to facilitate ease of handling for a do-it-yourself home craftsman.

2. Description of the Prior Art

It is common practice in home workshops to employ clamping apparatus to properly secure boards, panels or similar workpieces to a table top or workbench prior to cutting or finishing. Generally one uses C clamps or vises. When a C clamp is used, the securing of a workpiece in a stable fashion is possible only when the workpiece rests on the work table with its broad dimension in contact with the surface of the table. This position, however, considerably limits the free workability of the workpiece. A vise makes it possible to clamp a board on its narrow edge in different swiveling variations for the holding of a board. However, vises which offer these variations are relatively expensive and for this reason are not attractive to the do-it-yourself home craftsman.

OBJECTS OF THE INVENTION

The object of the present invention is to provide a clamping apparatus which, on the one hand, makes possible numerous positions for clamping a workpiece onto a table top or workbench and, on the other hand, is simple to construct, easy to handle and the production of which is relatively economical.

SUMMARY OF THE INVENTION

In the present invention there is provided a C-shaped clamping element which may be clamped onto a table top, the clamping body of which has a stop projecting upwardly above a guide ledge of the C clamp forming thereby a right angled receiving space for a workpiece. A U-shaped clamping element is provided which, while encircling the workpiece, may be clamped onto the projecting stop of the C clamp. A centrally located centering aperture developed as a penetrating or continuous hole is provided in said projecting stop of the C clamp into which a centering head from the U clamp may be introduced on either side thereof.

According to a preferred embodiment of the invention, provision is made for the upwardly projecting stop of the C clamp to be a simple extension of the back of the clamping body. This stop is provided at each of its three free sides with an easily accessible receiving groove, the width of which is equal to the width of the back of the clamping body of the U clamp. All three of these receiving grooves lie at the same distance from the centering aperture of the projecting stop.

The advantage of the invention lies in the combination of two clamps which may be used independently of one another whereby the home craftsman is given a means which, with the various possibilities of clamping positions, provides an apparatus similar to an expensively furnished workbench equipped with integrated attaching vises at a fraction of the cost thereof.

The stop of the C clamp projects beyond and perpendicular to the table top which makes it possible to fit boards in a secured position with their broad side against the perpendicular stop. A selected board may be fitted to either side of the broad sides of the projecting stop of the C clamp and thereafter fixed by placing the clamping body of the U clamp over the upper edge of the board in which case the front ends of the board are completely free and accessible for processing. Alternatively, the U clamping body may be arranged to encircle the front end of the board in which case the upper, narrow side of the board lies free for processing, for example planing, veneering, or the attachment of another element.

The projecting stop of the C clamp may consist of a flat extension of the back of the clamp body or may consist of a generally rectangular piece fastened to the guide ledge of the C clamp. In both cases the projecting stop provides a large outside contact surface against which boards or panels may be clamped, either on top of the guide ledge or suspended against either side of the projecting stop.

The receiving grooves in the projecting stop of the C clamp, in combination with the central centering aperture in the stop, facilitate the clamping of a board due to the fact that the U clamp is held in said receiving grooves even before it is tighteded which alleviates the necessity to hand-hold the workpiece during assembly.

According to a further embodiment of the invention, the centering head of the U clamp screw consists of a plug having a contact shoulder, the plug length of which is shorter than the axial length of the centering aperture in the projecting stop of the C clamp. The plug is securely fixed on the rotatable screw of the U clamp and therefore rotates as the screw is turned. Since the plug of the centering head does not project beyond the thickness of the projecting stop of the C clamp, the workpiece will be clamped between relatively large surfaces which thus prevents damage to the board caused by excessive local clamping pressure.

Another embodiment of the invention provides a modification of the guide ledge of the C clamp whereby a generally centrally located slot is provided to receive the clamping body of the U clamp in order that the U clamp may be pointed in an upward direction. As a result of this, a favorable clamping position of a board is made possible for numerous types of processing.

BRIEF DESCRIPTION OF THE DRAWINGS

The invention will be described in more detail on the basis of two embodiments shown in the drawings as follows:

FIG. 3 shows the clamping apparatus of FIG. 1 in side elevational view with a board attached and suspended in front of the work table as an illustration of a second clamping application;

FIG. 4 shows the clamping apparatus of FIG. 1 viewed from the front with the board extending horizontally and attached in front of the work table as a third illustration of clamping application;

FIG. 5 is a side elevational view along the section line V—V of FIG. 4 showing said third illustration of clamping application;

DESCRIPTION OF THE PREFERRED EMBODIMENT

Figure 1:
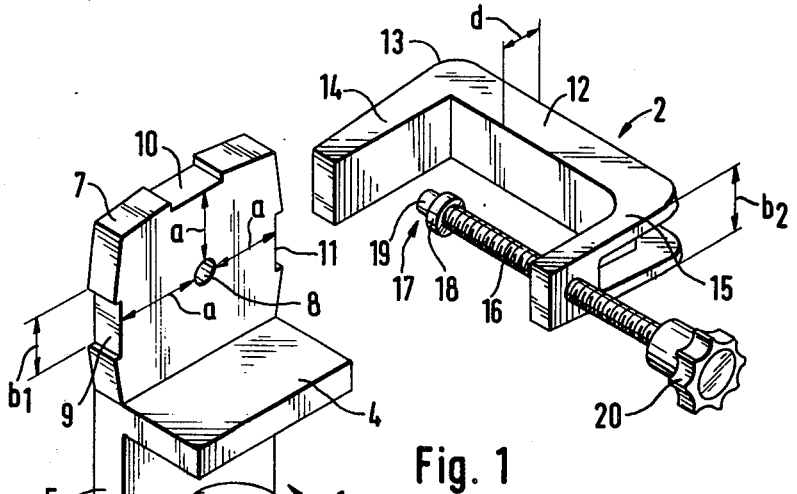
FIG. 1 shows in perspective view a clamping apparatus consisting of a C-shaped clamping element and a U-shaped clamping element in combination to illustrate the the cooperation of these elements.

FIG. 1 shows a clamping apparatus according to the invention adapted to be clamped to a table top in a do-it-yourself home workshop comprising a C-shaped clamping element 1 provided with a horizontal guiding ledge 4 and an upwardly projecting stop 7, both of which serve to contact a workpiece at a right angle intersection of the ledge 4 and stop 7. The apparatus shown in FIG. 1 is further provided with a U-shaped clamping element 2 which, in conjunction with the C-shaped clamping element 1, serves to hold said workpiece in a desired fixed position. The U clamp 2 comprises a U-shaped body portion having back 12, leg 14, leg 15, and a threaded screw element 16 with a centering head 17 on one end thereof and a manually turned knob 20 on the other end. Screw element 16 engages a threaded aperture on leg 15 of of the U clamp 2. A centrally located aperture 8 in the upwardly projecting stop 7 of the C clamp 1 cooperates with the centering head 17 of the screw element 16 of the U clamp 2 to thereby encircle the workpiece.

In FIGS. 1 through 5 it is seen that the body 3 of the clamp of the C-shaped clamping element has the form of an "F" set on its head which is subdivided into a supporting or guiding ledge 4, a back 5 below the ledge 4, a lower leg 6 for receiving the threaded element of the C clamp 1 and a stop 7 projecting above and beyond the leg 4 forming an extension on the back 5. The guiding ledge 4 and the stop 7 stand perpendicular to one another and form a rectangular receiving space for the workpiece. In stop 7 there is provided a central aperture 8 developed as a continuous hole. Moreover, stop 7 presents three free sides, each of which is provided with a receiving groove 9, 10 and 11 respectively. The width of each groove is generally equal to the width of $b_2$ of the back 12 of the clamp body portion 13 of the U clamp 2. The receiving grooves 9, 10 and 11 all lie at the same distance a from the centering aperture 8.

The clamp body 13 of the U clamp 2 comprises a back 12, a contact leg 14 and a guiding leg 15 for guiding the clamping screw 16. A centering head 17 is attached to the screw 16 which may be plugged into the centering aperture 8 of the projecting stop 7 of the C-shaped clamping element. The centering head 17 consists of a plug 19 provided with a stop shoulder 18, the plug-in length of the plug 19 being shorter than the axial length of the centering aperture 8. The centering head 17 moves rotatably and concurrently with the axial direction of the screw 16. The screw 16 has a knob 20 serving as a handle for manual turning to clamp the U clamp to the workpiece.

Figure 2:
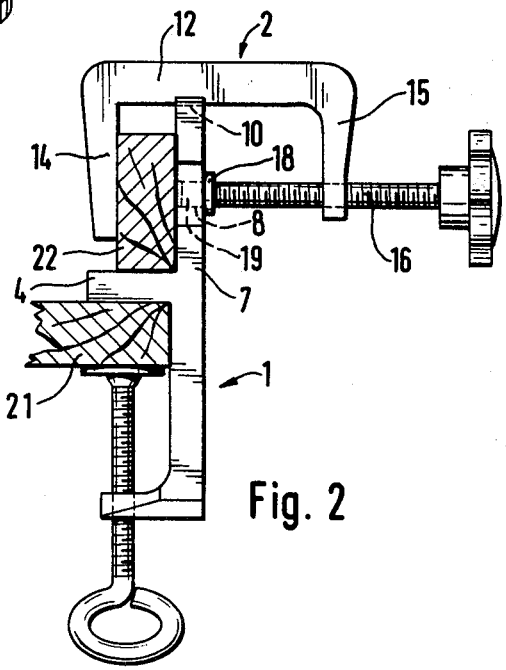
FIG. 2 shows the clamping apparatus of FIG. 1 in side elevational view with a clamped board as an illustration of of clamping application with the threaded screw element of the U-shaped clamping element engaging the central aperture of the C-shaped clamping element.

In FIGS. 2 to 5 the C-shaped clamping element 1 is shown as being screwed onto a work table top 21. Different clamping positions are shown in these Figures. In FIG. 2 a strip 22 is clamped between the projecting stop 7 of the C clamp 1 and the contact leg 14 of the U clamp 2 whereby the strip rests on the guiding ledge 4 of C clamp 1. The back 12 of the U clamp lies in the upper receiving groove 10 of the C clamp 1 so that the U clamp encircles the strip 22 from above. The shoulder 18 of the centering head 17 of the clamping screw 16 is supported by the outside of the stop 7 while the plug 19 is guided in the continuous hole 8.

In FIG. 3 the U clamp 2 is turned 180 degrees, as compared to FIG. 2, and is turned in such a way that its screw 16 now lies above the table top 21. Between its leg 14 and the outside of stop 7 a board 23 is clamped and suspended perpendicularly whereby the U clamp 2 encircles the board 23 from above.

In FIGS. 4 and 5 a board 24 extending horizontally is clamped between the outside surface of the stop 7 of the C clamp and the leg 14 of the U clamp so that the U clamp encircles a front end of the board 24 laterally with the back 12 of the U clamp lying in the lateral groove 11 of the stop 7. The board 24 obviously may also be clamped on the inside of stop 7 of the C clamp in order that the U clamp may be disposed in a position which is turned 180 degrees from that illustrated in FIGS. 4 and 5. This last position is particularly suitable for planing and sanding work since the board 24 need only be clamped very loosely.

Figure 6:
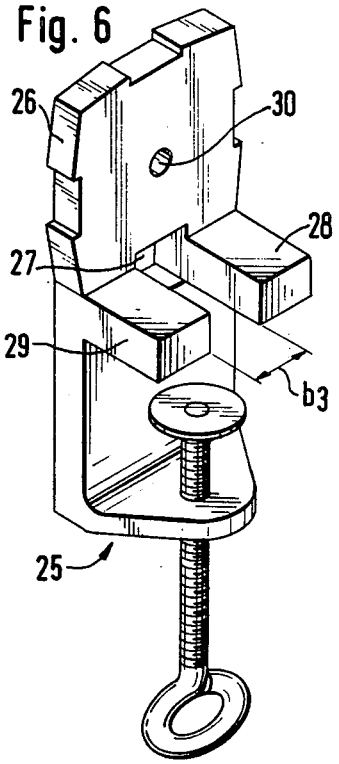
FIG. 6 shows an alternate embodiment of the invention with a modification of the guide ledge of the C-shaped clamping element in persepctive view.
Figure 8:
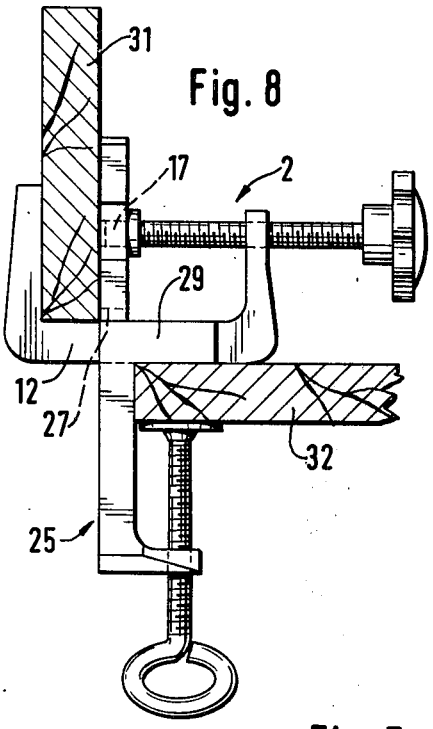
FIG. 8 shows a sectional view along the section line VIII—VIII of FIG. 7.
Figure 7:
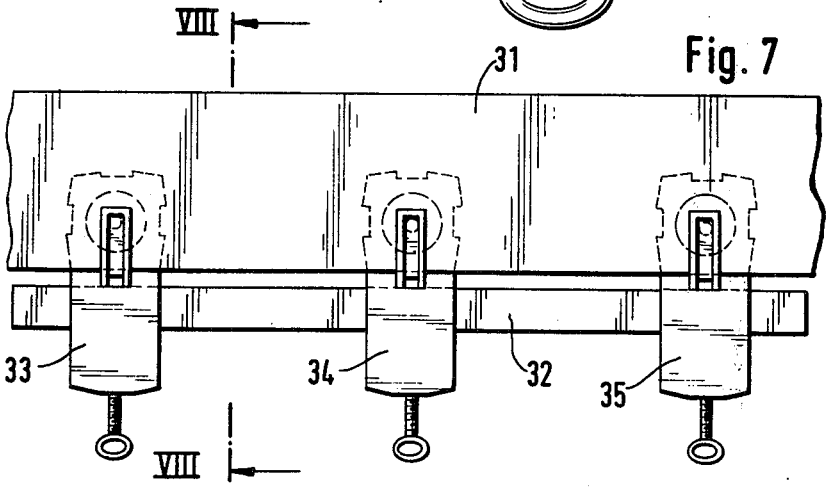
FIG. 7 shows a plurality of C-shaped clamping elements used in the manner of FIG. 6.

FIG. 6 shows a structural modification of the C-shaped clamping element 25 in which the guiding ledge portion has been changed but which cooperates with the U clamp of FIG. 1. The guiding ledge has been cut out in its central region to provide a break-through 27 which subdivides the guiding ledge into two supporting legs 28 and 29. The inside distance $b_3$ as shown in FIG. 6 represents the separation of the supporting legs 28 and 29 and is equal to the width $b_2$ of the back 12 of the U clamp. The thickness of the supporting legs 28 and 29 corresponds to the thickness d of the back 12 of the U clamp. The U clamp may be selectively fitted from either side of the break-through 27 of the projecting stop 26 with the U aperture pointing upwards into the C clamp 25 as is apparent in FIG. 8.

When the centering head 17 of the U clamp 2 is introduced into the centering aperture 30 in the center of the projecting stop 26, the back 12 of the U clamp 2 lies in flush fit between the supporting legs 28 and 29 and supplements them in order to effect a complete and continuous supporting surface. In this position, the U clamp 2 positioned into the C clamp 25, the clamping apparatus fulfills the function of a vise with a receiving space for the workpiece which opens toward the top.

Although in the above description the cooperating clamps have been defined as a C-shaped clamping element and a U-shaped clamping element and also as a C clamp and a U clamp, in the following claims the terms C clamp element and U clamp element will be used in the interest of brevity.

Having thus disclosed, I now claim:

1. A clamping apparatus for clamping a workpiece onto a table top or workbench comprising:

a C clamp element and a U clamp element;

said C clamp element having one leg adapted as a guiding ledge, a straight back, a threaded screw element to attach it to a table top or workbench threadedly engaging a bottom leg and an upwardly projecting stop having a centrally located aperture therein;

said U clamp element having a U-shaped body portion, a straight back having a width $b_2$, two legs and a threaded screw element fitted with a centering head at one end thereof and a knob at the other end thereof, said screw element engaging a threaded orifice in one leg of said U clamp element; and said centering head of said threaded screw element being adapted to fit into the centrally located aperture of said upwardly projecting stop of said C clamp element whereby the workpiece may be fitted and thereafter secured within the right angled receiving space between the guiding ledge and the projecting stop or suspended at the back of said projecting stop with the U clamp element encircling said workpiece.

2. Apparatus as claimed in claim 1 wherein said upwardly projecting stop of said C clamp element is a flat extension of the back of said C clamp element and is provided with a receiving groove having a width $b_1$, which is approximately equal to the width $b_2$ of the back of the U clamp element, placed in each of the three free sides of the projecting stop at an equal distance a from said centrally located aperture thereby adapting the back of the U clamp element to fit into any one of the receiving grooves on any one of the three free sides of the projecting stop for securing the workpiece on said projecting stop in a variety of clamping positions.

3. Apparatus as claimed in claim 1 wherein said centering head comprises a plug having a contact shoulder portion and an axial length which is shorter than the depth of the centrally located aperture within the projecting stop of the C clamp element.

4. Apparatus as claimed in claim 2 wherein said upwardly projecting stop and said guiding ledge of said C clamp element are each provided with a centrally located cut out portion having a width $b_3$ equal to the width $b_2$ of the back of the U clamp element to thereby allow the back of said U clamp element to be fitted into said guiding ledge with the U-shaped body turned upwardly under said upwardly projecting stop thereby facilitating the fitting of the U clamp element into the breakthrough opening of the cut out portion so that the guiding ledge provides a continuous, uninterrupted surface comprising the back of the U clamp element and the two support legs of the guiding ledge, said surface holding the workpiece on said guiding ledge with relatively light pressure from the threaded screw element of said U clamp element.

* * * * *